United States Patent [19]

Chakrabarti et al.

[11] Patent Number: 4,814,959

[45] Date of Patent: Mar. 21, 1989

[54] HEAT SHIELD FOR LOW PROFILE AUTOMOTIVE HEADLIGHT

[75] Inventors: Kirti B. Chakrabarti, Danvers; George J. English, No. Reading, both of Mass.

[73] Assignee: GTE Products Corporation, Danvers, Mass.

[21] Appl. No.: 160,363

[22] Filed: Feb. 25, 1988

[51] Int. Cl.[4] ..... F21V 29/00

[52] U.S. Cl. ..... 362/294; 362/345; 362/61; 362/226; 313/117

[58] Field of Search ..... 362/61, 80, 294, 345, 362/226, 373, 264, 296, 297, 303, 346, 267; 313/113, 114, 117

[56] References Cited

U.S. PATENT DOCUMENTS

| | | | |
|---|---|---|---|
| 4,156,901 | 5/1979 | Haraden et al. | 362/296 |
| 4,280,173 | 7/1981 | Bradley et al. | 362/294 |
| 4,308,574 | 12/1981 | Fratty | 362/303 |
| 4,555,748 | 11/1985 | Bradley | 362/294 |
| 4,563,730 | 1/1986 | Saito | 362/264 |
| 4,679,127 | 7/1987 | Ernst et al. | 362/345 |
| 4,703,401 | 10/1987 | Ichihara et al. | 362/294 |
| 4,747,029 | 5/1988 | Liverance | 362/226 |

FOREIGN PATENT DOCUMENTS

| | | | |
|---|---|---|---|
| 2022234 | 12/1979 | United Kingdom | 362/61 |

*Primary Examiner*—Ira S. Lazarus
*Assistant Examiner*—D. M. Cox
*Attorney, Agent, or Firm*—Edward J. Coleman; William E. Meyer

[57] ABSTRACT

A motor vehicle headlight module is provided which is compact in design having a plastic reflector with a protruding rear portion forming a chamber from which a lighting capsule extends. A heat shield of thermal insulative material is disposed above the capsule and in spaced relation with the capsule and reflector to inhibit the reflector from reaching its heat deflection temperature.

18 Claims, 3 Drawing Sheets

HEAT SHIELD FOR LOW PROFILE AUTOMOTIVE HEADLIGHT

BACKGROUND OF THE INVENTION

The present invention relates to a headlight module for use in a lighting assembly for motor vehicles, and more particularly to a heat shield for use in a headlight module of the type designed for improved aerodynamic performance of the motor vehicle on which it is used.

In the following U.S. patent applications, all assigned to the assignee of the present invention, there are disclosed various embodiments of motor vehicle lighting systems which are directed to the improvement of lighting systems from the aspect of aerodynamic design, function, ease of replacement and manufacture, etc.

For example, in Ser. No. 598,604, now U.S. Pat. No. 4,545,001, entitled "Sealed Lens Member For Use In A Motor Vehicle Lighting System" (Inventors: G. J. English et al), there is defined a hollow, single piece lens member for use in a motor vehicle lighting system containing a plurality of individual lighting modules.

In Ser. No. 598,613, now U.S. Pat. No. 4,569,002, entitled "Motor Vehicle Lighting System" (Inventors: G. J. English et al), there is defined a motor vehicle lighting system wherein a plurality of modules are used in combination with a common lens member designed to control the light from the module.

In Ser. No. 598,614, now U.S. Pat. No. 4,646,207, entitled "Motor Vehicle Lighting System Including A Sealed Lens Member As Part Thereof" (Inventors: R. E. Levin et al), there is defined a motor vehicle lighting system including a light source and reflector means, a hollow, enclosed lens having a contoured front surface with a rear lensing surface, and a means for mounting the lens in a recess of said vehicle to assure adequate passage of light from the source through the lens.

In Ser. No. 598,605, now U.S. Pat. No. Des. 285,351, entitled "Lamp Reflector Module For Use In A Motor Vehicle Headlighting System" (Inventors: G. J. English et al), there is claimed the ornamental design for a lamp-reflector module for use in a motor vehicle lighting system.

In Ser. No. 598,606, now U.S. Pat. No. Des. 284,112, entitled "Lens Member For A Motor Vehicle Headlighting System" (Inventors: G. J. English et al), there is claimed the ornamental design for a motor vehicle headlight lens member having a plurality of stepped lensing surfaces thereof and a slightly curved forward surface.

In Ser. No. 598,607, now U.S. Pat. No. Des. 283,362, entitled "Lens Component For A Motor Vehicle Headlighting System" (Inventors: R. E. Levin et al), there is claimed the ornamental design for a motor vehicle headlight lens having a sloped, clear front surface, a pair of side walls, a bottom wall, and a stepped, rear lensing portion to in turn define a sealed, single piece component.

In Ser. No. 598,615, now abandoned, entitled "Lighting Module For Motor Vehicle Lighting System" (Inventors: G. J. English et al), there is defined a lighting module for use as a part of a vehicle headlighting system wherein the module includes a reflector, a small tungsten halogen capsule sealed within the reflector, and a clear, front cover providing a seal for the module.

All of the above-identified applications were filed Apr. 10, 1984 and are assigned to the same assignee as the instant invention.

In addition to the above, in Ser. No. 840,271, now U.S. Pat. No. 4,707,767, entitled "Motor Vehicle Headlight Module" (Inventors: J. A. Bergin et al), there is defined a headlight module of compact design wherein a connector is provided which is designed for being slidably located on the projecting rear neck portion of the module's reflector. A retention means projects from the reflector to engage (e.g. lock onto) the connector and hold it in position.

In Ser. No. 840,268, now U.S. Pat. No. 4,660,128, entitled "Motor Vehicle Lighting Assembly" (Inventors: J. A. Bergin et al), there is defined a headlight lighting assembly wherein a plurality of modules are utilized. Each module, including a singular reflector and small tungsten halogen light source (capsule) is designed to fit within a respective compartment of a common holder. The holder in turn may be aligned within the designated motor vehicle.

Both of these latter applications, filed Mar. 17, 1986, are assigned to the same assignee as the instant applications.

In corresponding U.S. patent application, Ser. No. 016,616, now U.S. Pat. No. 4,772,989 entitled "Motor Vehicle Headlight Module" filed in the name of Thomas Haraden and assigned to the assignee of the present invention, there is defined a motor vehicle module wherein the reflector includes a dual chambered protruding rear portion, a pair of conductive terminals securedly positioned within this rear portion, a contact member including an insulative body portion and a pair of electrical contacts positioned thereon and a lighting capsule (e.g., low wattage tungsten halogen) designed for being initially secured to the contact member such that this assembly (capsule-contact member) can then be precisely oriented within a first of the two chambers of the reflector. During such positioning, the contacts of the contact member which are electrically connected (e.g., forming part of the vehicle's electrical circuitry) may then be positioned within the second chamber and thus electrically coupled to the precisely oriented capsule, said connection being established through the positioned conductive terminals.

The aforementioned co-pending application is herein incorporated by reference as it discloses structure intended as a best mode of constructed the invention disclosed therein, which is further considered to be the best mode for carrying out the present invention.

In the design of a headlight module of the type having improved aerodynamic performance, it is proposed to employ lightweight materials which are readily available and which are adaptable to the relatively compact design. Modules have been constructed which possess an overall forward height of only about 2 inches and a width of about 2½ inches, and which can be readily produced using mass production techniques. In such designs, the reflector for the headlight module, in addition to having the above qualities, must provide the reflective qualities demanded by the automotive industry. Therefore, in the construction of reflectors of this type, one may choose from a number of thermal plastic materials having a high degree of specular mirror surface.

In choosing a preferred material for the reflector having in the desired compact design, a problem often exists at that area where the lighting capsule extends into the reflector producing a relatively high degree of heat at the upper portion of the reflector due to both convection and radiation from the lighting capsule. Should the heat exceed the heat deflection temperature of the thermal plastic material from which the reflector is fabricated, the reflective surface of the reflector would become distorted, and the precise configuration of the module would be destroyed.

It is therefore an object of the present invention to provide a motor vehicle headlight module having a reflector formed of a plastic material wherein the dimensional integrity of the reflector is maintained during operation of the headlight.

A further object of the invention is to provide a motor vehicle headlight module having a reflector formed of a plastic material wherein a heat shield is provided to protect the reflector material from radiated and convected heat generated by the lighting capsule.

Another object of the invention is to provide a motor vehicle headlight module having a heat shield disposed therein for protection of the reflector from radiation and convection heat generated by the lighting capsule, and wherein the capsule and heat shield are connected to form an integral assembly for movement within the module during assembly.

Yet another object of the invention is to provide a motor vehicle headlight module of the type described which is light-weight, of simple construction and adaptable to mass production techniques.

SUMMARY OF THE INVENTION

The aforementioned objects and other objects which will become apparent as the description proceeds are accomplished by providing a motor vehicle headlight module comprising a reflector formed of a plastic material and including wall structure forming a protruding rear portion having an aperture formed therein defining a chamber. The reflector comprises a reflective portion having wall structure intersecting the wall structure of the protruding rear portion and a lighting capsule is disposed in the chamber and has a portion thereof extending forwardly in spaced relation with the aforementioned reflecting portion. A heat shield formed of insulative material is disposed above the lighting capsule and in spaced relation with the capsule. The heat shield extends into the reflector, the forward end of the heat shield terminating in a forward edge thereof which is disposed in spaced relation with and adjacent to the intersection of the reflecting portion wall structure with the protruding rear portion wall structure.

The lighting capsule generally comprises an elongated cylindrical envelope and the heat shield comprises an arcuate wall facing the cylindrical envelope and substantially following the cylindrical surface contour of the envelope.

Means may be provided connecting the heat shield with the lighting capsule to form an integral assembly whereby movement of the lighting capsule in the forward or rearward direction, or in a direction at right angles thereto, is ineffective to change the spaced relation between the capsule and the heat shield during assembly of the module.

BRIEF DESCRIPTION OF THE DRAWING

The foregoing and other features of the invention will be more particularly described in connection with a preferred embodiment, and with reference to the accompanying drawing, wherein.

BEST MODE FOR CARRYING OUT THE INVENTION

Figure 1:
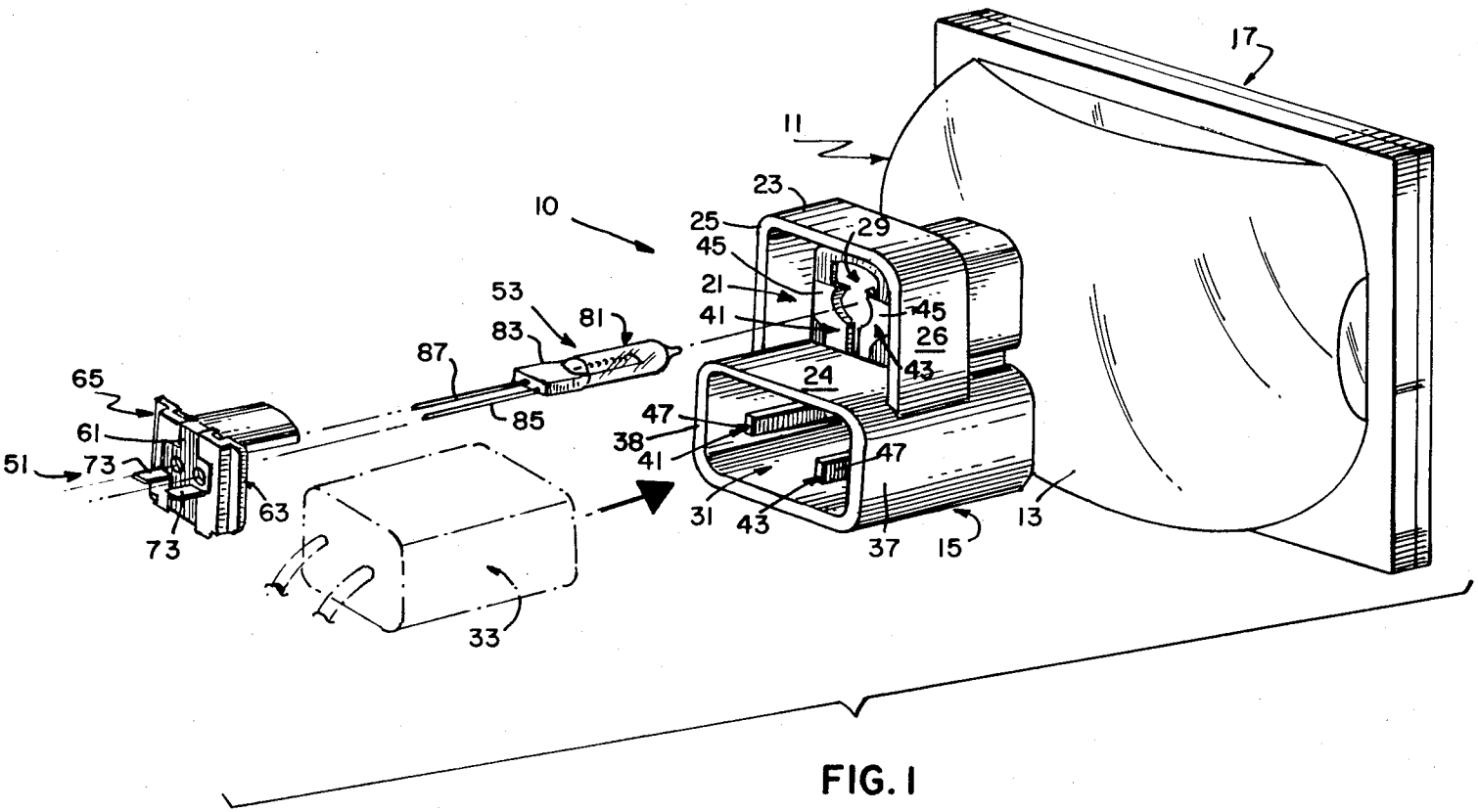
FIG. 1 is an exploded elevational perspective view of a motor vehicle headlight embodying a heat shield constructed in accordance with the teachings of the present invention.

For a better understanding of the present invention, reference should be made to the following disclosure and appended claims in connection with the above-described drawing.

With particular attention to the drawing, there is illustrated a motor vehicle headlight module 10 in accordance with a preferred embodiment of the invention. As stated, module 10 is adapted for use within a motor vehicle lighting assembly as part thereof, examples of such an assembly being defined in prior referenced U.S. Patent Applications Ser. No. 840,268 and Ser. No. 016,616, the disclosures of which are both incorporated herein by reference. More specifically, module 10 is adapted for being positioned within a common holder member of the like such as described in U.S. Ser. No. 840,268 to be aligned therein such that the completed assembly (including a plurality, e.g., four of such modules) can then be aligned within the respective motor vehicle in which the assembly is utilized. Advantageously, the assembly as defined in U.S. Ser. No. 840,268 possesses a small overall height and occupies a relatively small frontal area, thus allowing the vehicle in which it is located to possess a corresponding reduced frontal section. Improved aerodynamics are thus realized. Additional features of such an arrangement are fully described in U.S. Ser. No. 840,268.

As shown in FIG. 1, module 10 includes an electrically insulative (e.g., plastic) reflector 11 which includes a reflecting portion 13 which has projecting therefrom a protruding rear neck portion 15. Reflector 11 also includes a forward lens member 17 which is secured across the reflector's forward, rectangular opening to provide a closure therefor. Lens 17 is preferably glass (e.g., borosilicate) and is secured to the reflector's forward portion by a suitable adhesive known in the art.

Figure 3:
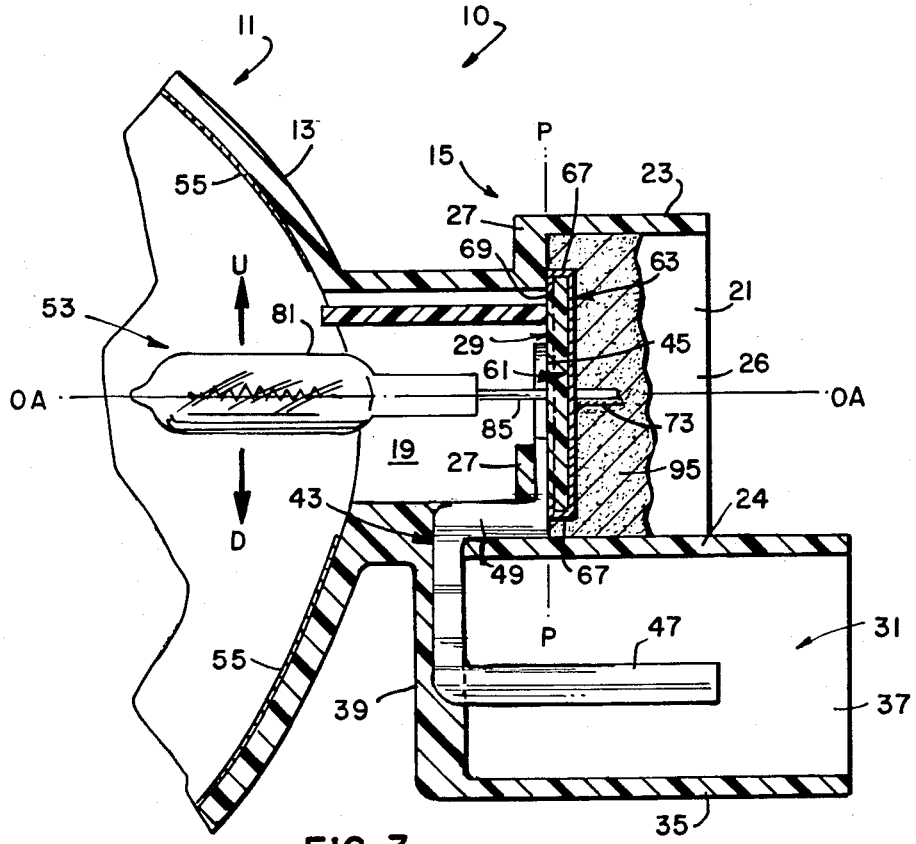
FIG. 3 is a cross-sectional elevational view showing a portion of the structure of FIGS. 1 and 2 in the assembled configuration.

Reflector 11, as also shown in FIG. 3, further includes an aperture 19 therein which passes from the reflecting portion of the reflector through the protruding rear portion to a first chamber 21 formed at the rear thereof. Rear chamber 21 as shown, is of substantially rectangular (boxlike) configuration and is defined by upper and lower walls 23 and 24, by parallel walls 25 (FIG. 1) and 26, and by a rear wall 27 having an opening 29 therein. Located below first chamber 21 is a second chamber 31 which is separated from first chamber 21 by a common wall 24 and which serves to house (receive) an external connector 33 (shown in phantom in FIG. 1) which in turn is connected to or forms part of the motor vehicle's electrical system. Chamber 31, like upper chamber 21, is defined by opposing pairs of parallel walls (upper and lower walls 24 and 35, and opposing side walls 37 and 38) in addition to a back wall 39 which depends (projects) downwardly from the part of the protruding rear portion of the reflector 11 in which aperture 19 is located. Chamber 31 is thus also of substantially rectangular (boxlike) configuration.

Module 10 further includes first and second electrically conductive terminals 41 and 43 (only 43 shown in FIG. 3) which are securedly positioned within the reflector's protruding rear neck portion. Each conductive terminal includes a first segment 45 located within rear portion 15 relative to first chamber 21 and a second segment 47 which passes through the common wall 24 and projects within the second chamber 31. As stated, the first segment 45 of each terminal is located relative to the first chamber 21. This is meant to include the situation wherein the first segment protrudes within the first chamber 21 or, alternatively, lies substantially flush within the rear wall 27 thereof (as shown in FIG. 3). The illustrated second segments 47 which project within second chamber 31 are specifically designed for being electrically coupled to contacts (not shown) located within the connector 33. Preferably, such contacts are spring-type contacts for engaging opposite sides of the substantially flat, male protruding second segments. Interconnecting segments 45 and 47 is a main body segment 49 which, as shown in FIG. 3, is also embedded within the rear wall 39 of rear portion 15. Such an arrangement, in addition to the positioning of first segment 45 within wall 27, serves to firmly secure the terminals in the desired orientation. Positioning in such a fixed relationship is considered important for the reasons cited hereinbelow. Significantly, the substantially flat first segments 45 of terminals 41 and 43 occupy a common, first plane (P—P in FIG. 3) when so positioned within reflector 11.

Module 10 further includes a contact member 51 which, as defined, is designed for being positioned within first chamber 21 of reflector 11 in a predetermined, aligned manner such that the module's light source (lighting capsule 53) will be properly aligned within reflector 11 relative to the reflecting surfaces of portion 13. Such reflecting surfaces are typically located on the internal walls of reflecting portion 13 and, in one embodiment, were of a thin coating of aluminum reflecting material 55 (FIG. 3). The walls of reflecting portion 13 are also preferably of substantially parabolic configuration and terminate at the outer extremities thereof (upper, lower and side) in substantially flat, parallel portions (see FIG. 1).

Figure 2:
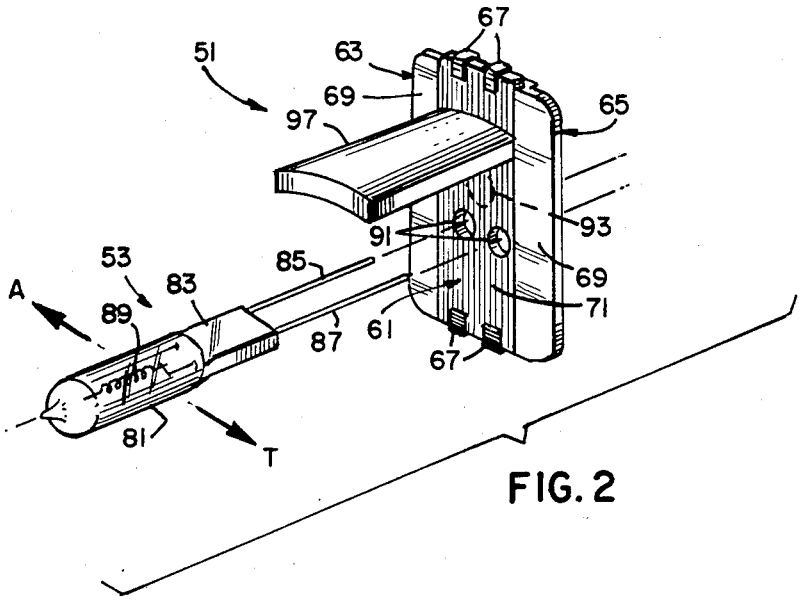
FIG. 2 is an exploded elevational perspective view showing details of a portion of the structure of FIG. 1 taken on an enlarged scale for clarity.

Contact member 51 includes an electrically insulative (e.g., plastic) body portion 61 and first and second electrical contacts 63 and 65 which are spacedly positioned on body portion 61 and secured thereto. This preferred securement, as shown in FIG. 2, is achieved through the utilization of projecting tabs 67, two of which project from opposite ends of each contact and are formed about the upper and lower ends of the insulative body portion. Contacts 63 and 65, being electrically isolated by the insulative body portion, each project outwardly therefrom and include a flattened contacting segment 69 designed for being electrically connected to a respective one of the first segments 45 of the securedly positioned conductive terminals 41 and 43. Both of the contacting segments 69 occupy a common place with the forward, planar surface 71 of body portion 61 to define a combined flat surface for this portion of member 51. When contact member 51 is positioned within chamber 21 (as shown in FIG. 3), the plane defined by this forward, flat surface 71 of body portion 61 to define a combined flat surface for this portion of member 51. When contact member 51 is positioned within chamber 21 (as shown in FIG.3), the plane defined by this forward, flat surface lies co-planar with the plane (P—P) defined by the positioned first segments of conductive terminals 41 and 43. This facilitates alignment of the contact member which in turn facilitates alignment of lighting capsule 53. This alignment will be defined in greater detail hereinbelow. Projecting rearwardly from each electrical contact is a tab segment 73 which, as shown, extends substantially perpendicular to the plane defined by the forward surface 71 of contact member 51.

As stated, module 10 further includes a lighting capsule 53 which in turn includes an envelope 81 having a press sealed end 83 from which projects a pair of conductive lead-in wires 85 and 87 (only wire 85 shown in FIG. 3), said wires in turn electrically coupled to the filament 89 located within the capsule's envelope. Capsule 53 is preferably a low wattage, tungsten halogen capsule. By low wattage is meant a wattage no greater than about 25 watts and by tungsten halogen is meant a capsule wherein the filament is a coiled tungsten configuration and wherein the atmosphere contained within the envelope includes a halogen. Tungsten halogen lamps are well known in the art and further description is thus not believed necessary. Capsule 53 is secured to contact member 51 by attaching (e.g., welding) each of the projecting lead-in wire conductors to a respective tab segment 73 of the electrical contacts 63 and 65. Only one wire (85) is shown in FIG. 3 but it is understood that both wires are so connected, particularly considering the illustrations in FIGS. 1 and 2. Thus, wire 85 is connected to the tab segment 73 of contact 63 while wire 87 is connected to the corresponding tab segment of contact 65. Such connection enables precise orientation of the capsule (and particularly its internally contained filament structure) relative to the planar contacting surfaces 69 of the contact member's secured contacts.

In assembly, the lead-in wire conductors are inserted within corresponding apertures 91 (FIG. 2) in the insulative body portion 61 to a pre-established depth and thereafter secured (welded) to tab segments 73. Should excessive wire exist, it may be trimmed (cut) at this time such that the terminal ends of each wire lie substantially flush with the ends of tab segments 73 (as shown in FIG. 3). Alternatively, tab segments 73 could each be in the form of a hollow eyelet as an integral part of the respective contact with the respective wire passing therethrough. Such an arrangement would enable each wire to be secured to such an eyelet by soldering. Such an eyelet could also be a separate element used to retain the respective contact to the insulative body portion. In an even more form than any of the above, the segments could be eliminated altogether and the wire conductors directly secured (e.g., soldered or welded) to the respective contact after passing through an aperture therein. Because such attachment precisely orients the capsule relative to the contact member's forward contacting surfaces, it also precisely orients the capsule relative to the reflector's reflecting surfaces 55 once the capsule-contact member assembly is fully positioned within chamber 21 in contact with the respective first segments of terminals 41 and 43. As will be further defined, this represents but one of three orientations for capsule 53.

Once assembled, contact member 51 is inserted within chamber 21 such that the forward contacting surfaces 69 thereof engage and lie flush against the described first segments, thus occupying the aforementioned co-planar orientation. Prior to such positioning, however, glass lens 17 is sealed to the forward opening of reflector 11 (e.g., using a suitable epoxy known in the art). Preferably, the reflector during such orientation is positioned face down, enabling the capsule and contact member assembly to be vertically lowered through the rear of the reflector (through chamber 21 and aperture 19). The capsule is thus strategically positioned at a precise depth within reflector 11 and must now be aligned respective to the optical axis OA—OA (FIG. 3) thereof. This is accomplished next by moving the capsule-contact member assembly along two planes by a suitable mechanism (e.g., using a contact member gripping mechanism which projects downwardly). These two planes of movement are understood to be substantially perpendicular to each other, thus representing two additional directions of orientation for capsule 53. In FIG. 3, for example, capsule 53 may be moved upwardly and/or downwardly (directions U and D, respectively) along a first such plane. Additionally, capsule 53 (and contact member 51) may also be moved along a plane perpendicular to the optical axis OA—OA in FIG. 3 (and thus toward and/or away from the viewer).

These opposing directions are represented by the directional arrows T and A in FIG. 2. Thus, it can be seen that the opposing directions of movement (T and A) occupy a plane substantially vertical to those directions (D and U) shown in FIG. 3. Once the capsule-contact member assembly is precisely oriented in the predetermined orientation within reflector 11, the first and second electrical contacts 63 and 65 of the contact member are electrically connected (e.g., welded) to the corresponding first segments 45 of terminals 41 and 43. As stated, this preferred means of securement is by welding, and, more specifically, using laser welders directed downwardly through chamber 21.

With capsule 53 now precisely oriented with reflector 11, the reflector may be subjected to various flushing and fill operations (e.g., nitrogen flush) known in the art. Such flushing and filling can occur through an opening 93 (shown in phantom in FIG. 2) provided within insulative portion 61. Subsequently, this opening is sealed as are any remaining open portions (e.g., openings 91) using a quantity of sealant 95 (FIG. 3) which is deposited within first chamber 21. As shown, sealant 95 substantially covers the secured contact member and thus provides an effective seal for chamber 21. In a preferred embodiment, sealant 95 was an epoxy material applied in liquid form and subsequently hardened.

To provide increased protection for the interior surfaces of the plastic reflector 11 from the heat generated by the capsule 53 during operation of the module 10, a contact member 51 includes a projecting heat shield 97 which extends perpendicularly from the planar body portion 61 and is disposed in spaced relation with the capsule 53, extending into the interior of the reflector. In the present embodiment, the heat shield 97 forms part of the insulative body portion 61 of the contact member 53. However, it should be understood that the present invention is not so limited, and the heat shield 97 may be a separate element either secured to the contact member 53 by a suitable adhesive or in some manner attached to the structure to which the capsule 53 is attached to form an integral assembly. By forming such a construction, the assembly of the capsule 53 and the heat shield 97 may be moved in the upward or downward position, or in the forward and rearward direction without changing the spaced relation between the capsule and the heat shield during assembly of the module 10. It should here be noted that the spaced relation between the capsule 53 and the heat shield 97 is critical for the reasons which will be set forth below.

As stated above, the reflector 11 is preferably of a plastic material and is chosen from a lightweight thermoplastic generally having a high degree of specular mirror surface necessary to meet the requirements of an automobile headlight of the type described. Materials which have proven satisfactory for use in the subject invention are a thermoplastic sold under the trademark, Ryton by the Philips Chemical Company, Bartlesville, Okla. and the material Ultem 4006 which is a thermoplastic copolymer material manufactured by the General Electric Corporation. While the materials mentioned have proven satisfactory for light reflective surfaces in the compact configuration as described, the capsule 53 extending from the aperture 19 into the reflector, requires that the coil or filament 89 of the capsule 53 be located in close proximity to the reflector 11. It has been found that a critical portion C—C exists above the capsule 53 which may be adversely effected by the combination of radiation heat from the filament 89 as well as a convectional heat caused by gasses rising from the heat generated by the capsule 53. Should the heat produced at this point exceed the heat deflection temperature of the material provided for the reflector 11, distortion would occur in the reflector which would adversely effect the internal configuration of the reflector and the critical dimensions thereof.

Figure 4:
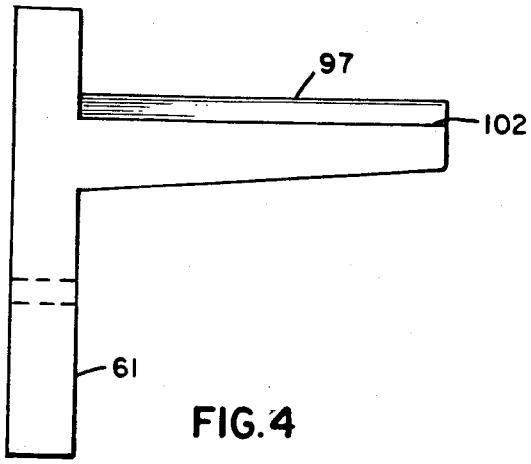
FIG. 4 is a side elevational view showing details of the heat shield of FIGS. 1 through 3.
Figure 5:
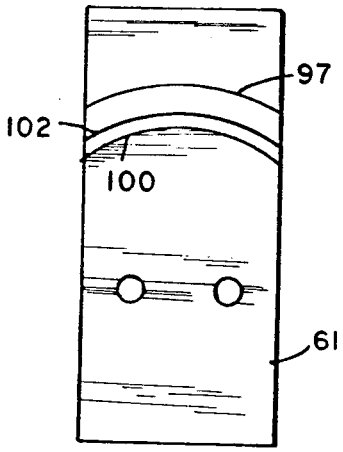
FIG. 5 is a front elevational view showing further details of the heat shield of FIG. 4.

Referring now to FIG. 4 and FIG. 5, the heat shield 97 is shown in its disclosed form as a integral part of the insulative body portion 61, although the heat shield may be a separate element, and of different material than the member 61. The heat shield 97 is manufactured of an insulative material such as Xydar which is a liquid crystal polymer thermoplastic manufactured by Dartko Corporation of Augusta, Ga. It will also be noted that the heat shield 97 is formed having an arcuate wall 100 facing downwardly toward the cylindrical surface of the capsule 53 and substantially following the contour of the cylindrical surface.

Referring now to FIG. 3, it will be noted that the heat shield 97 is disposed in spaced relation with the capsule 53 and extends into the reflector 11. The forward end of the heat shield 97 terminates in a forward edge 102 which is disposed in spaced relation with, and adjacent to, the intersection of the reflecting portion 13 wall structure with that of the protruding rear portion wall structure forming aperture 19. The edge 102 is thus aligned slightly within the confines of the reflective portion 13 and serves to shadow the area C—C from the radiational heat of the capsule 53. In the present embodiment, the shield 97 extends for a distance which measures in the area of 10 to 50 thousands beyond the intersection of the wall structure of the reflective portion 13 and the wall structure forming the aperture 19. Additionally, the arcuate surface 100 is effective to trap the flow of hot gas and direct it away from this area C—C to inhibit heat of convection rising from the capsule, from contacting the critical area C—C.

In the design of the heat shield 97, it is imperative to employ a non-conductive heat material such as the Xydar material as the heat shield 97 is intended not as a light deflector but as an insulator of both convective and radiated heat energy. The material chosen for the heat shield must also demonstrate a heat deflection temperature which is in excess of that of the materials being employed for the reflector 13. In the presently disclosed embodiment, the Ryton material demonstrates a heat deflection temperature in the area of 260° C. while the Ultem material demonstrates a heat deflection temperature in the area of 210° to 220° C. Other known materials having characteristics applicable to use as a deflector have deflection temperatures which may be in the range of 150° C. to 300° C. While the material to be employed for the heat shield 97 is not limited to the Xydar material, Xydar demonstrates a heat deflection temperature in the area of 346° C. to 355° C. As the Xydar heat deflection temperature is at least 86° C. greater than the heat deflection temperature of either plastic material suggested for use in the reflector 11, this material has proven to be adequate to protect the critical area C—C in the embodiment disclosed. Materials such as ceramics have also provided good insulating characteristics, however it has been found that the materials employed in the application require some form of processing to remove any contaminating agents. When the Xydar material is employed, it is vacuum baked for two hours at 325° C.

Of importance also is the means of connecting the heat shield 97 with the lighting capsule 53 to form some type of integral assembly such that movement of the lighting capsule in the forward or rearward direction or in a direction at right angles thereto does not change the spaced relation between the capsule and the heat shield during assembly of the module. This dimension locating the shield 97 relative to the capsule 53 becomes critical in that the heat shield 97 should be so located that it shields the critical area C—C while not inhibiting the lighting function of the module 10 by overly extending into the reflecting portion 13 of the module 10.

From the foregoing, it is evident that there has been shown and described a motor vehicle headlight module which is light-weight and of relative compact design in which the heat generated by the lighting capsule does not adversely effect the internal configuration of the reflector due to heat deflection of the material. This has been accomplished by providing a heat shield which is so constructed and so located as to protect the reflecting portion of the module from both convection heat and radiation heat generated by the lighting capsule.

What is claimed:

1. A motor vehicle headlight module comprising:

a reflector formed of a plastic material and including wall structure forming a protruding rear portion having an aperture formed therein defining a chamber;

said reflector comprising a reflecting portion having wall structure intersecting said wall structure of said protruding rear portion;

a lighting capsule partially disposed in said chamber and having a portion thereof extending forwardly and in spaced relation with said reflecting portion; and a heat shield formed of insulative material disposed above said lighting capsule and in spaced relation with said capsule and extending into said reflector, the forward end of said heat shield terminating in a forward edge thereof which is disposed in spaced relation with and adjacent to the intersection of said reflecting portion wall structure with the protruding rear portion wall structure.

2. A motor vehicle headlight module as set forth in claim 1 wherein said reflector plastic material is a thermoplastic polymer or copolymer material.

3. A motor vehicle headlight module as set forth in claim 1 wherein said reflector plastic material demonstrates a heat deflection temperature in the area of 150° C. to 250° C.

4. A motor vehicle headlight module as set forth in claim 1 wherein said heat shield insulative material demonstrates a heat deflection temperature greater than the heat deflection temperature of said reflector material.

5. A motor vehicle headlight module as set forth in claim 1 wherein said heat shield insulative material demonstrates a heat deflection temperature at least 86° C. greater than the heat deflection temperature of said reflector plastic material.

6. A motor vehicle headlight module as set forth in claim 1 wherein said heat shield insulative material demonstrates a heat deflection temperature greater than 346° C.

7. A motor vehicle headlight module as set forth in claim 1 wherein said lighting capsule comprises an elongated cylindrical envelope and said heat shield comprises an arcuate wall facing said cylindrical envelope and substantially following the cylindrical surface contour thereof whereby both heat of convection and radiation generated by the said lighting capsule are intercepted by said arcuate wall of said heat shield.

8. A motor vehicle headlight module as set forth in claim 1 wherein said lighting capsule is a tungsten halogen capsule having a wattage no greater than 25 watts.

9. A motor vehicle headlight module as set forth in claim 1 wherein said forward edge of said heat shield extends in the area of 0.010 inch to 0.050 inch beyond the intersection of said reflecting portion wall structure with the protruding rear portion wall structure.

10. A motor vehicle headlight module as set forth in claim 1 which further includes means connecting said heat shield with said lighting capsule to form an integral assembly whereby movement of said lighting capsule in the forward or rearward direction, or in a direction at right angles thereto during assembly of said module is ineffective to change the spaced relation between said capsule and said heat shield.

11. A motor vehicle headlight module as set forth in claim 10 wherein said lighting capsule comprises an elongated cylindrical envelope and said heat shield comprises an arcuate wall facing said cylindrical envelope and substantially following the cylindrical surface thereof whereby the heat of convection and radiation generated by said lighting capsule are intercepted by said arcuate wall of said heat shield.

12. A motor vehicle headlight module as set forth in claim 11 wherein said reflector plastic material is a thermoplastic polymer or copolymer material.

13. A motor vehicle headlight module as set forth in claim 12 wherein said heat shield insulative material is a polymer thermoplastic material.

14. A motor vehicle headlight module as set forth in claim 13 wherein said forward edge of said heat shield extends in the area of 0.010 inch to 0.050 inch beyond the intersection of said reflecting portion wall structure with the protruding rear portion wall structure.

15. A motor vehicle headlight module as set forth in claim 14 wherein said reflector plastic material demonstrates a heat deflection temperature in the area of 150° C. to 300° C.

16. A motor vehicle headlight module as set forth in claim 15 wherein said heat shield insulative material demonstrates a heat deflection temperature greater than 346° C.

17. A motor vehicle headlight module as set forth in claim 11 wherein said heat shield insulative material demonstrates a heat deflection temperature greater than the heat deflection temperature of said reflector plastic material.

18. A motor vehicle headlight module as set forth in claim 17 wherein said lighting capsule is a tungsten halogen capsule having a wattage no greater than 25 watts.

* * * * *